US006135075A

United States Patent [19]

Boertje et al.

[11] Patent Number: 6,135,075

[45] Date of Patent: Oct. 24, 2000

[54] VARIABLE CAM MECHANISM FOR AN ENGINE

[76] Inventors: Brian H. Boertje, 105 7th Ave., P.O. Box 57, Sully, Iowa 50251; Louis L. Crago, P.O. Box 113, Campbell, Nebr. 68932

[21] Appl. No.: 09/266,086

[22] Filed: Mar. 10, 1999

[51] Int. Cl.[7] ..... F01L 13/00

[52] U.S. Cl. ..... 123/90.16; 123/90.39

[58] Field of Search ..... 123/90.15, 90.16, 123/90.17, 90.22, 90.39, 90.41, 90.44, 90.45

[56] References Cited

U.S. PATENT DOCUMENTS

| | | | |
|---|---|---|---|
| 4,459,946 | 7/1984 | Burandt | 123/90.16 |
| 4,697,473 | 10/1987 | Patel | 74/519 |
| 4,726,332 | 2/1988 | Nishimura et al. | 123/90.16 |
| 4,741,297 | 5/1988 | Nagahiro et al. | 123/90.16 |
| 4,762,096 | 8/1988 | Kamm et al. | 123/90.16 |
| 4,899,701 | 2/1990 | Inoue et al. | 123/90.16 |
| 5,018,487 | 5/1991 | Shinkai | 123/90.16 |
| 5,025,761 | 6/1991 | Chen | 123/90.16 |
| 5,148,783 | 9/1992 | Shinkai et al. | 123/90.16 |
| 5,189,998 | 3/1993 | Hara | 123/90.16 |
| 5,203,289 | 4/1993 | Hara et al. | 123/90.16 |
| 5,431,132 | 7/1995 | Kreuter et al. | 123/90.16 |
| 5,515,820 | 5/1996 | Sugimoto et al. | 123/90.16 |
| 5,732,669 | 3/1998 | Fischer et al. | 123/90.16 |
| 5,899,180 | 5/1999 | Fischer | 123/90.16 |
| 6,019,076 | 2/2000 | Pierik et al. | 123/90.16 |
| 6,041,746 | 3/2000 | Takemura et al. | 123/90.16 |

*Primary Examiner*—Weilun Lo
*Attorney, Agent, or Firm*—Zarley, McKee, Thomte, Voorhees & Sease

[57] ABSTRACT

A variable cam mechanism for an engine includes a pivot shaft and a plurality of rocker arms pivotally mounted on the pivot shaft, at least some of which operatively engage a valve. A cam shaft extends generally parallel to the pivot shaft and transverse to the rocker arms. The cam shaft has cams secured thereon which are registered with the respective rocker arms so as to selectively contact them when the cam shaft rotates. A spring biased boost cam engages one of the rocker arms. An actuator connected to the boost cam changes the spring bias and thereby changes the timing and duration of contact between the boosted rocker arm and its cam. By moving the actuator, the operator can select between regular, low-speed mode and a boosted, high-speed mode.

28 Claims, 12 Drawing Sheets

VARIABLE CAM MECHANISM FOR AN ENGINE

BACKGROUND OF THE INVENTION

The present invention relates to the field of automotive engines. More particularly, this invention relates to a variable cam mechanism for an engine. The variable cam mechanism can be applied to intake or exhaust valves or both. The variable cam mechanism provides improved control of the opening and/or the closing of the valves.

SUMMARY OF THE INVENTION

The present invention relates to a variable cam mechanism for controlling one or more valves in an engine. The invention is particularly well adapted to controlling valves in internal combustion engines. The variable cam mechanism includes a pivot shaft and a plurality of rocker arms pivotally mounted on the pivot shaft such that at least some of the rocker arms operatively engage a valve. A cam shaft extends generally parallel to the pivot shaft and transverse with the rocker arms. Cams on the cam shaft register with associated rocker arms so as to selectively contact them when the cam shaft rotates. A spring biased boost cam engages at least one of the rocker arms. An actuator connects to the boost cam so as to vary the spring bias. Directly or indirectly, the boost cam changes the timing and duration of contact between the cams on the cam shaft and the associated rocker arms so as to control the valve or valves. As a result, the operator can select between a regular, low-speed mode and a boosted, high-speed mode. Cam shaft cam profiles and phasing are disclosed to provide different timing, duration and valve opening in the boosted mode.

DETAILED DESCRIPTION OF THE PREFERRED EMBODIMENT

Figure 1:
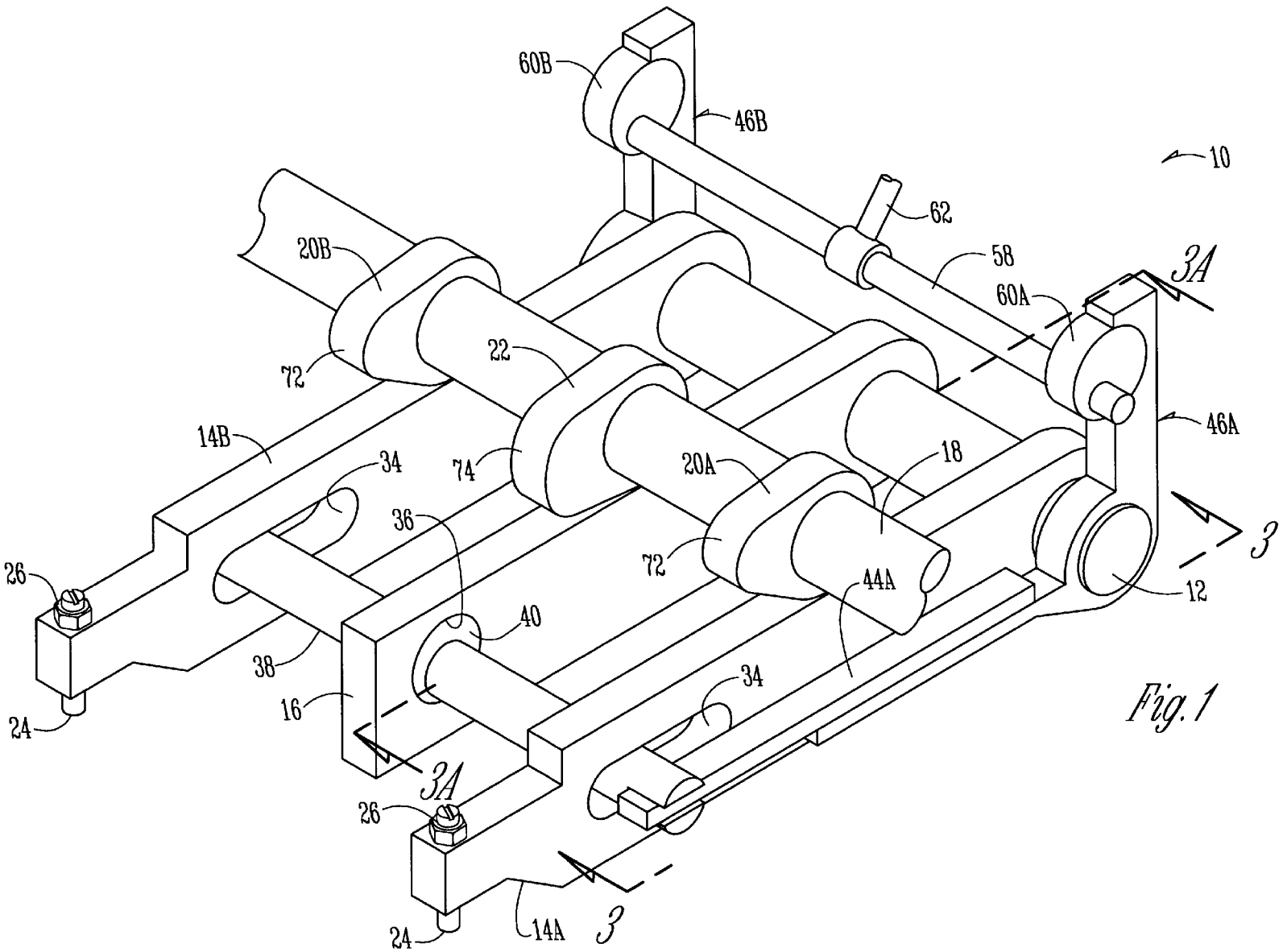
FIG. 1 is a perspective view of the variable cam mechanism of the present invention.
Figure 2:
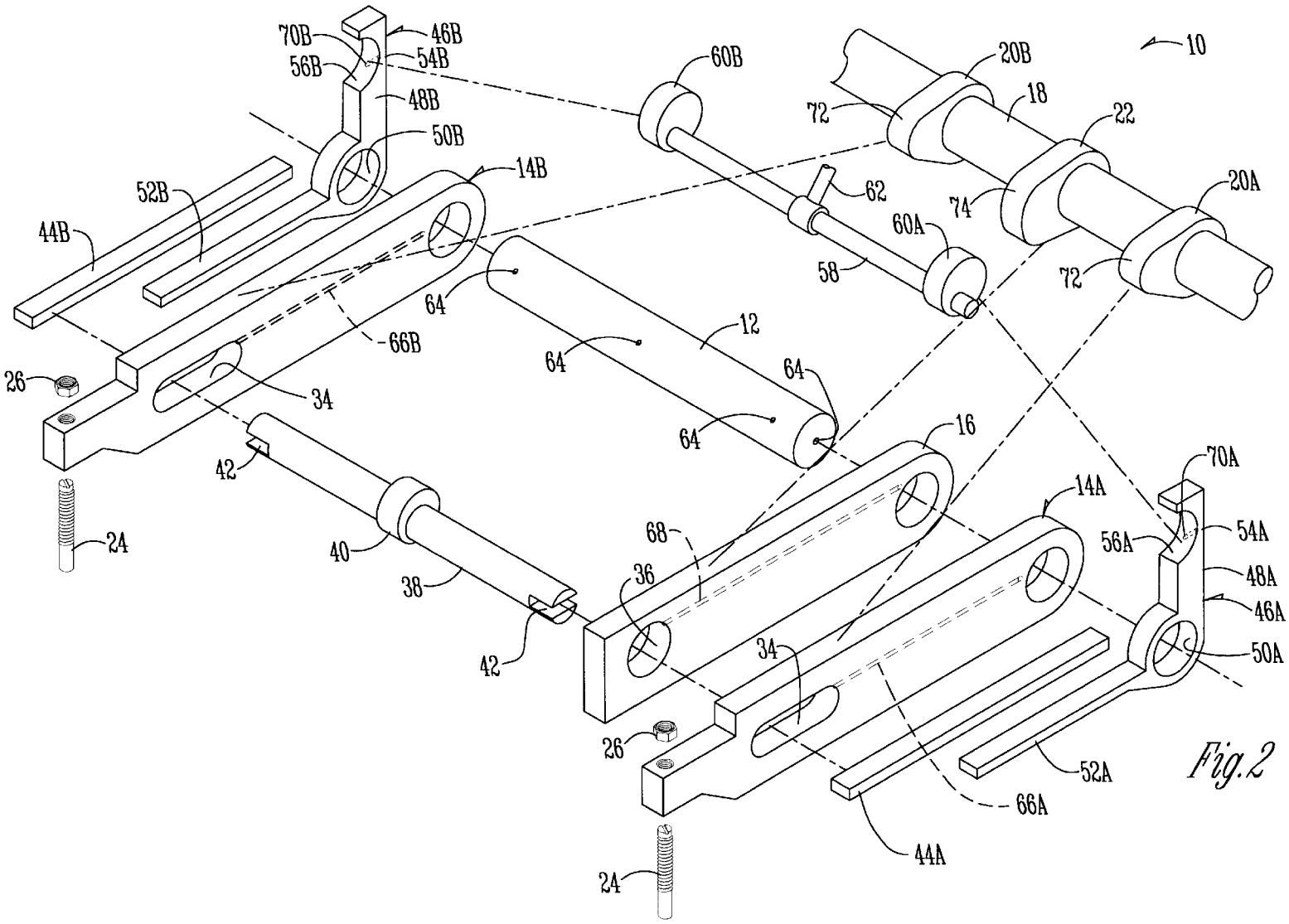
FIG. 2 is an exploded assembly view of the variable cam mechanism of the present invention.

In the figures, the variable cam mechanism of this invention is designated by the reference numeral 10. Referring to FIGS. 1 and 2, the cam mechanism 10 includes a rocker arm support and pivot shaft 12 on which a plurality of elongated rocker arms 14A, 16 and 14B are pivotally mounted. A cam shaft 18 extends transversely across the rocker arms 14A, 16 and 14B, preferably generally parallel to the pivot shaft 12. Cams 20A, 22, 20B are secured for rotation with the cam shaft 18. The cams 20A, 22, 20B are proximate to and generally registered with the rocker arms 14A, 16, 14B respectively so as to selectively contact them when the cam shaft 18 rotates. The rocker arms 14A, 14B are sometimes referred to herein as low-speed rocker arms. Rocker arm 16 is sometimes referred to herein as the high-speed rocker arm. Similarly, the cams 20A, 20B are sometimes referred to herein as the low-speed cams, whereas the cam 22 is referred to as the high-speed cam.

Figure 3:
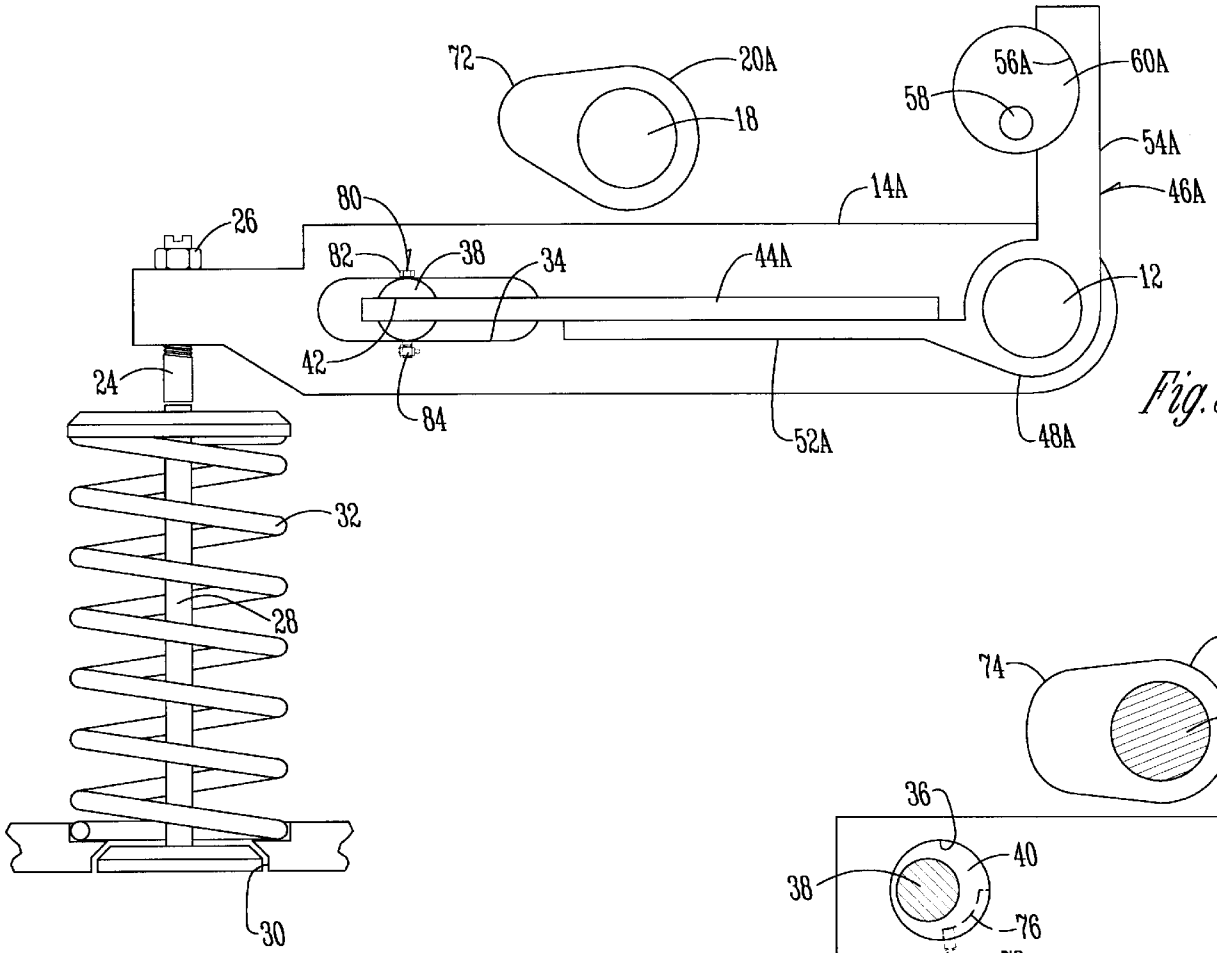
FIG. 3 is a side elevation view of the area around the low-speed rocker arm taken along line 3—3 in FIG. 1. A valve associated with the variable cam mechanism is also shown in the closed position.
Figure 3A:
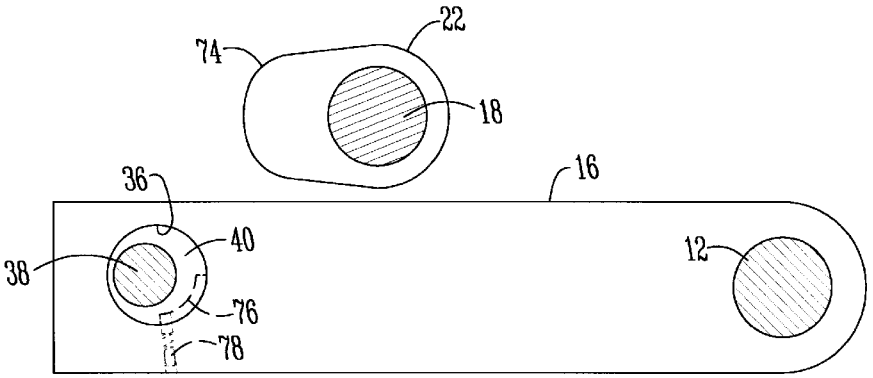
FIG. 3A is a side elevation view of the area around the high-speed rocker arm taken along line 3A—3A in FIG. 1. The cam shaft is in the same rotary piston as shown in FIG. 3.

The ends of the low-speed rocker arms 14A, 14B each have a valve adjustment screw 24 and a nut 26 associated therewith. Preferably the valve adjustment screw 24 threadably installs in the end of the rocker arm 14A, 14B that is remote from the rocker arm support and pivot shaft 12, as best seen in FIGS. 2 and 3. FIG. 3 illustrates that the free end of valve adjusting screw 24 is positioned so as to contact a conventional valve 28. The valve 28 is normally biased against a valve seat 30 by a valve spring 32. Conventional rocker arm return springs (not shown) can also be operatively associated with each rocker arm 14A, 16, 14B.

Referring again to FIGS. 1–3, the low-speed rocker arms 14A and 14B each have an elongated longitudinal (here horizontal) slot 34 therein remote from their pivotal connection with the pivot shaft 12. A cylindrical aperture 36 extends through the high-speed rocker arm 16 as shown in FIG. 2. A boost shaft 38 extends through the slots 34 and the aperture 36. The shaft 38 includes an eccentric wheel 40 centrally located thereon. The ends of the shaft 38 have centrally located slots 42 extending axially inward. The ends of the shaft 38 extend through the elongated slots 34 on the low-speed rocker arms 14A and 14B so that the slots 42 are at least partially exposed. A spring member 44A, 44B slidingly fits into the slot 42 outboard of each rocker arm 14A, 14B respectively.

As best seen in FIGS. 1–3, the spring members 44A, 44B are adjustingly engaged by actuator lever mechanisms 46A, 46B pivotally mounted on the pivot shaft 12 outboard of the low-speed rocker arms 14A, 14B respectively. The lever mechanisms 46A, 46B each include a body portion 48A, 48B having a hole 50A, 50B therein for slidingly receiving the pivot shaft 12 so that the lever mechanisms 46A, 46B can pivot therearound. The lever mechanisms 46A, 46B further include a spring-engaging lever arm 52A, 52B and an actuating lever arm 54A, 54B, which generally oppose each other and preferably are approximately perpendicular to each other. The spring-engaging lever arms 52A, 52B engage and support the rear end of the respective spring members 44A, 44B. The spring-engaging lever arms 52A, 52B preferably have a flat upper surface for slidably engaging the spring members 44A, 44B. The actuating lever arms 54A, 54B have cam receiving grooves 56A, 56B respectively which are offset from the hole 50A, 50B. The grooves 56A, 56B are generally shaped like a portion of a cylinder.

An actuating shaft 58 extends generally parallel to the cam shaft 18 and the pivot shaft 12. A pair of spring adjusting cams 60A, 60b are secured for rotation with the shaft 58. The cams 60A, 60B engage the lever mechanisms 46A, 46B at the respective grooves 56A, 56B. Conventional connecting means 62 rigidly attach to the shaft 58 so as to selectively rotate it, which causes the cams 60A, 60B to pivot the actuator lever mechanisms 46A, 46B with respect to the pivot shaft 12. Appropriate conventional control means, like a shifter mechanism (not shown), located in the driver's compartment of the vehicle and connected to the connecting means 62 gives the driver control of the variable cam mechanism 10 of the present invention.

Small oil holes or lubrication passages 64, 66A, 66B, 68, 70A and 70B may optionally extend through the components 12, 14A, 14B, 16, 46A, 46B respectively as shown in FIG. 2. Additional lubrication can also be provided around the lever arms 52A, 52B and the spring members 44A, 44B in a conventional manner.

Figure 4:
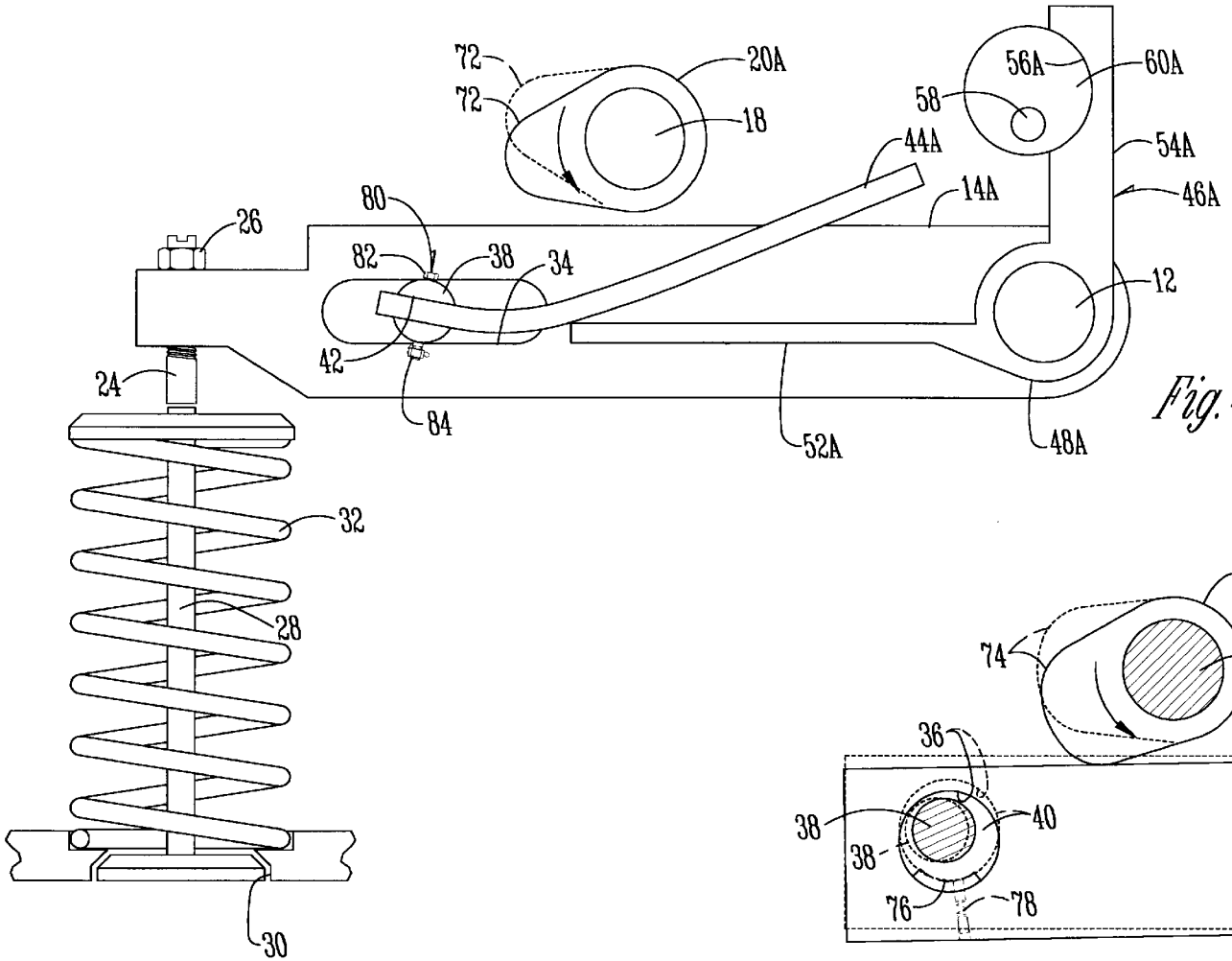
FIGS. 4 and 4A are similar to FIGS. 3 and 3A, but show the cam shaft rotated so that the high-speed cam and cam wheel put the spring adjacent the low-speed rocker arm in tension while the valve remains closed.
Figure 4A:
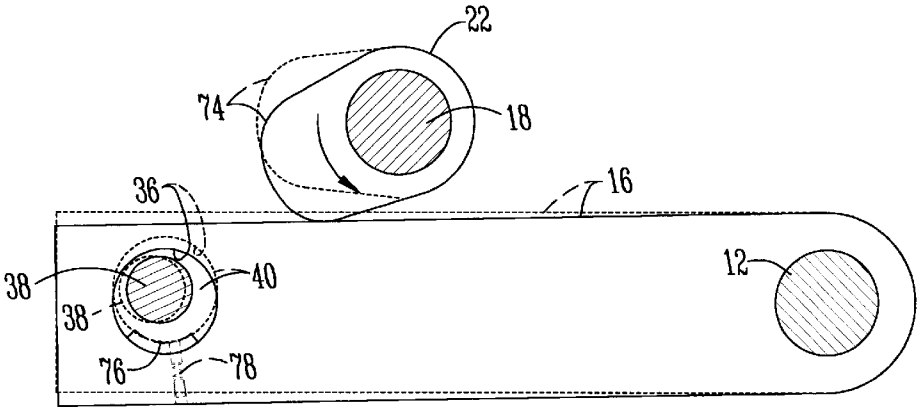

Greater detail will now be provided regarding the cams 20A, 20B, and 22 on the cam shaft 18. FIGS. 1 and 2 disclose that the low-speed cams 20A, 20B have an identical cam profile 72, which is formed by opposite sides connected together at a blunted apex and forming an acute angle. The cam profile 74 of the high-speed cam 22 also has opposite sides connected together by a blunted apex. However, the angle between the sides of cam profile 74 is not as sharp as between the sides of the cam profile 72. The cam profile 74 is a substantially rectangular tongue portion that protrudes from the cam shaft 18. The corners are radiused or rounded. The radius at the apex of cam profile 74 is greater, making the profile 74 blunter than the profile 72. Thus, the more blunt cam profile 74 provides both earlier and later contact, and consequently greater duration of contact with the rocker arm 16. Preferably the cam profiles 72, 74 are angularly phased with respect to the cam shaft 18 so that the low-speed cam profile 72 substantially registers with the trailing edge of the high-speed cam profile 74. As seen in FIGS. 4 and 4A, the high-speed cam 22 will generally contact its rocker arm 16 first because of its profile 74 and position on the cam shaft 18. Other cam profiles and phasing can also be provided with this invention. In fact, the alignment and profile (including length) of the cams 20A, 20B and 22 can be varied to affect the opening and closing times of the valves 28. See FIGS. 12A–12C for some examples of cam timing relationships possible with this invention.

Figure 12A:
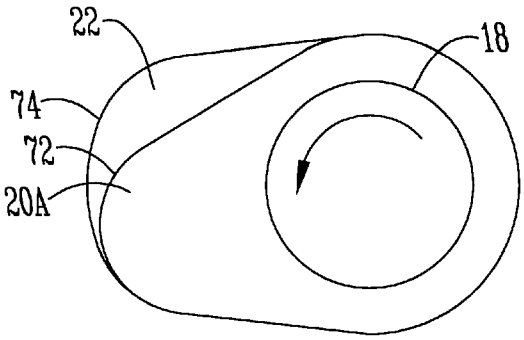
FIGS. 12A–12C are side elevation views of the cam profiles showing various timing or phasing relationships possible with this invention.
Figure 12B:
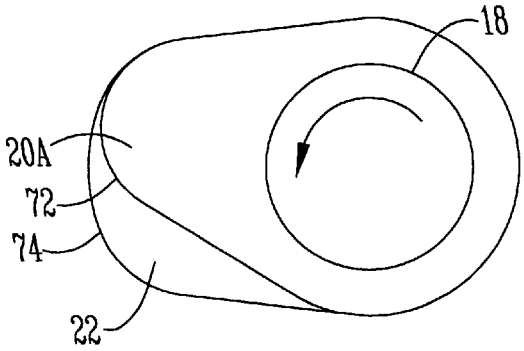
Figure 12C:
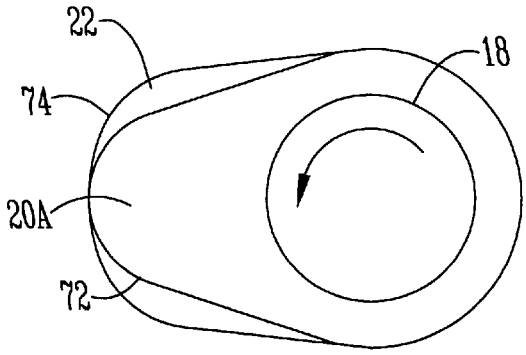

FIG. 12A shows the low-speed cam profile 72 in phase with the high-speed cam profile 74 during the initial opening of the valve. As in FIGS. 1–10, FIG. 12B shows the low-speed cam profile 72 in phase with the high-speed cam profile 74 during the closing of the valve. FIG. 12C shows the low-speed cam profile 72 in phase with the high-speed cam profile 74 after the opening of the valve and before the closing of the valve.

Figure 9:
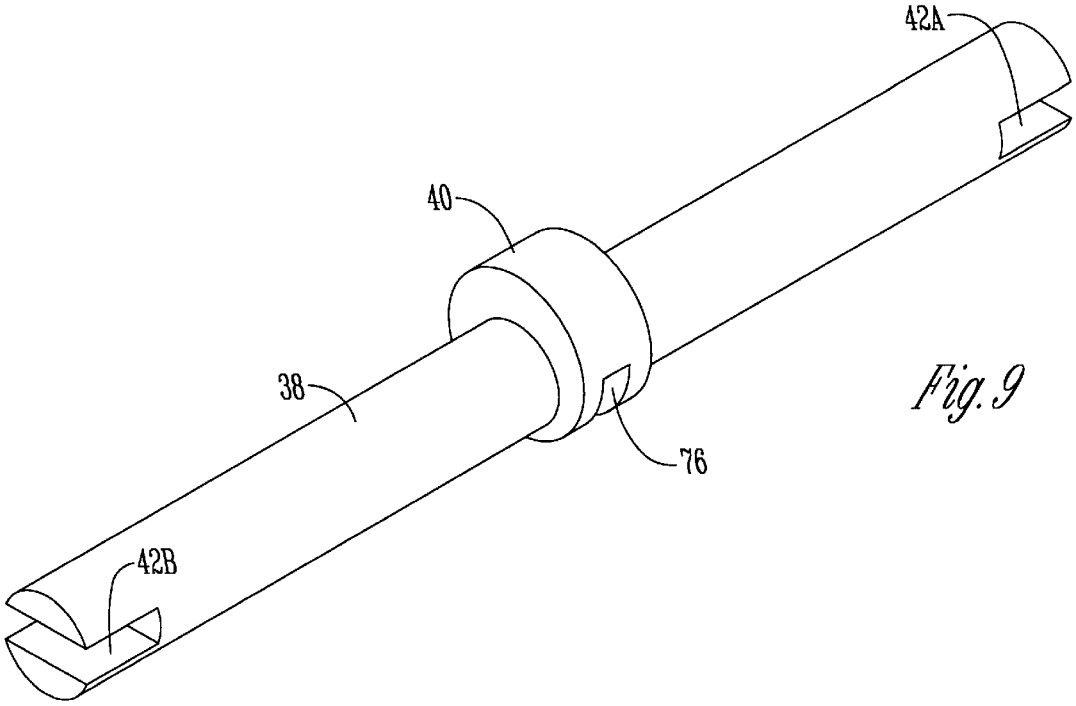
FIG. 9 is a perspective view of the cam wheel and shaft of this invention.
Figure 10:
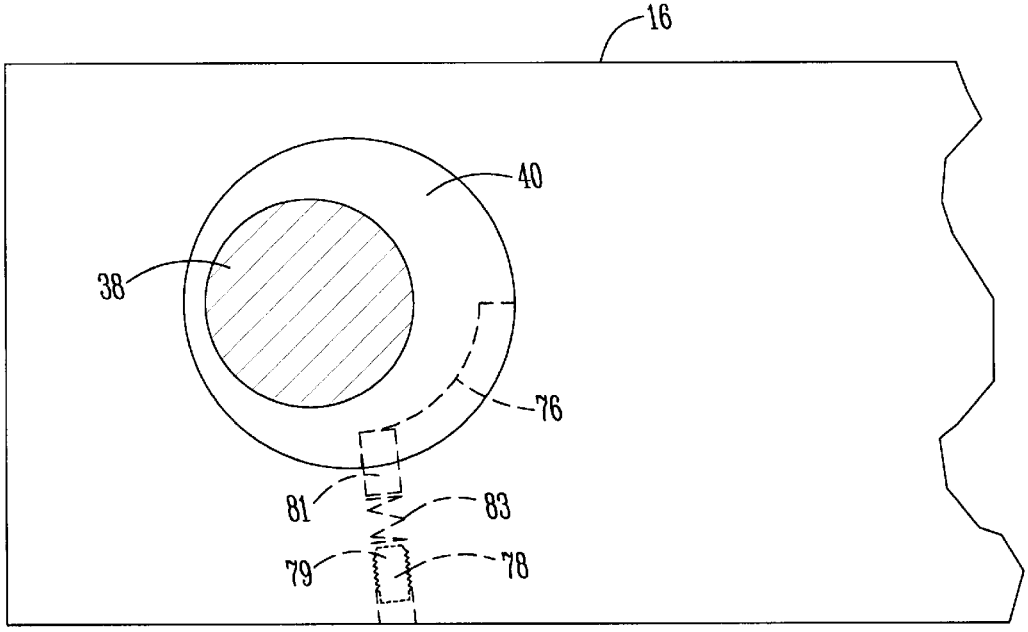
FIG. 10 is an enlarged partial side elevation view of the high-speed rocker arm, cam wheel and shaft, and set screw of this invention. To simplify the drawings, the lubrication holes have been omitted.
Figure 10A:
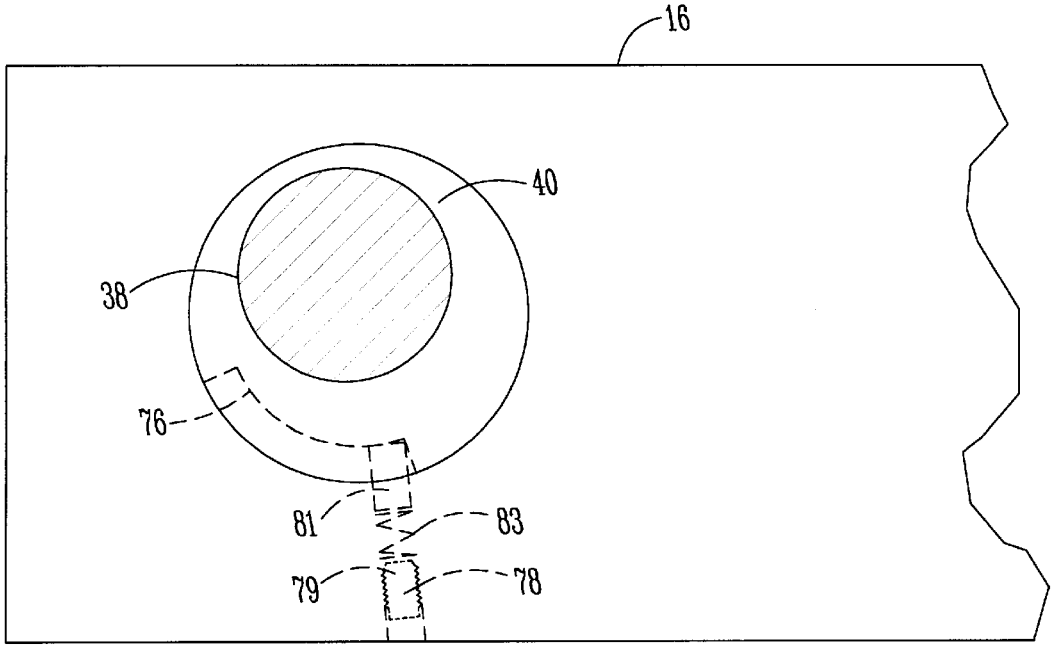
FIG. 10A is similar to FIG. 10, but shows the cam wheel oscillated to its extreme position in the opposite direction.

As best seen in FIGS. 2, 3A, 9, 10 and 10A, the eccentric wheel 40 is basically cylindrical in shape. The wheel 40 is "eccentric" by virtue of its eccentric mounting to the shaft 38. The eccentric wheel 40 has a centrally located peripheral groove 76 extending at least partially therearound. The groove 76 is adapted to receive a spring-loaded set screw assembly 78, which limits the rotation of the eccentric wheel 40 by abutment with the terminal ends of the groove 76. FIGS. 9, 10 and 10A show the cam shaft 38, the eccentric wheel 40, the groove 76 and the set screw assembly 78 in greater detail. In FIG. 10, the eccentric wheel 40 cannot rotate any farther counterclockwise because the set screw assembly 78 abuts one end of the groove 76. This is referred to as the zero-oscillation position (ZOP).

The zero-oscillation position is common in the high-speed mode shown in FIGS. 6–8A. In FIG. 10A, the eccentric wheel 40 cannot rotate any farther clockwise because the set screw assembly 78 abuts the other end of the groove 76. This is referred to as the maximum oscillation position (MOP). The MOP is frequently assumed in the low-speed mode and is depicted in FIGS. 3–5A. The spring-loaded set screw assembly 78 includes a set screw 79, a piston 81 and a spring 83 interposed therebetween. The set screw 79 is threaded and inserts into a threaded hole in the high-speed rocker arm 16 after the eccentric wheel 40, the piston 81 and the spring 83 have been installed.

Referring to FIG. 3, securement means 80 extends through the shaft 38 and through the respective spring member 44A, 44B to keep the end of the spring member 44A, 44B secured within the slot 42. The securement means 80 comprises a threaded pin 82 and a cotter pin 84 operatively attached thereto, but other conventional means can be utilized without detracting from the invention.

The variable cam mechanism 10 of the present invention provides a plurality of modes including a regular, low-speed mode, a boosted, high-speed mode, and an infinite number of positions between the extreme modes. The variable cam mechanism 10 has a regular, low-speed mode which is illustrated by FIGS. 1–5A. This mode is one of the extreme modes which can be initiated by the driver with the conventional shifter mechanism. The actuator cam 60A is set to the position shown in FIG. 3. The second extreme mode is the boosted, high-speed mode which is illustrated by FIGS. 6–8A. The actuator cam 60A is rotated clockwise into the position shown in FIG. 6. An infinite number of modes are possible between the extreme positions, but for practical purposes it may be desirable to limit the intermediate positions so that there are only two to four distinct modes and corresponding shifter positions. An automatic mode is also contemplated wherein the variable cam mechanism will automatically be switched from one mode to another, depending on sensed engine RPMs or some other measure of engine performance.

In the regular, low-speed mode, the engine RPMs are relatively low, and the eccentric wheel 40 is in the zero oscillation position or ZOP. See FIGS. 3 and 3A. The slots 42 in the ends of the eccentric wheel shaft 38 are disposed approximately horizontally. The cams 60A and 60B engage the respective actuating lever arms 54A, 54B, but the lever mechanisms 46A, 46B are in a position where the actuating lever arms 54A, 54B are substantially vertical and the spring-engaging lever arms 52A, 52B are substantially horizontal. Thus, since there is no outside force on the lever arms 54A, 54B, no additional force or tension is on the springs 44A, 44B.

In the position shown in FIGS. 1–3A, there is no contact between the rocker arms 14A, 14B and 16 and the respective cams 20A, 20B and 22. The mechanism 10 might be in this position when the engine is turned off and the cam shaft 18 has stopped rotating. When the operator starts the engine, the cam shaft 18 rotates in a counterclockwise direction as shown in FIGS. 4 and 4A. The gently rounded profile or lobe 74 of the high-speed cam 22 contacts the high-speed rocker arm 16 first. FIG. 4 shows the corresponding position of the low-speed cam 20A, which is identical to the position of the low-speed cam 20B. Notice that the cam 20A has not yet contacted the rocker arm 14A. Thus, there is no movement by the low-speed rocker arm 14A (and 14B) or the valve 28.

As shown by the solid lines in FIG. 4A, the eccentric wheel 40 oscillates clockwise from about a 9 o'clock position (shown by dashed lines) toward a 12 o'clock position. As a result of the oscillation of the eccentric wheel 40, the shaft 38 tends to slide in the slot 34 toward the pivot shaft 12 (compare FIG. 3 to FIG. 4). The shaft 38 also rotates clockwise slightly, which causes the spring 44A to be flexed or rotated. Again, the low-speed rocker arm 14A is not yet forced to move. Thus, the valve 28 remains closed.

Figure 5:
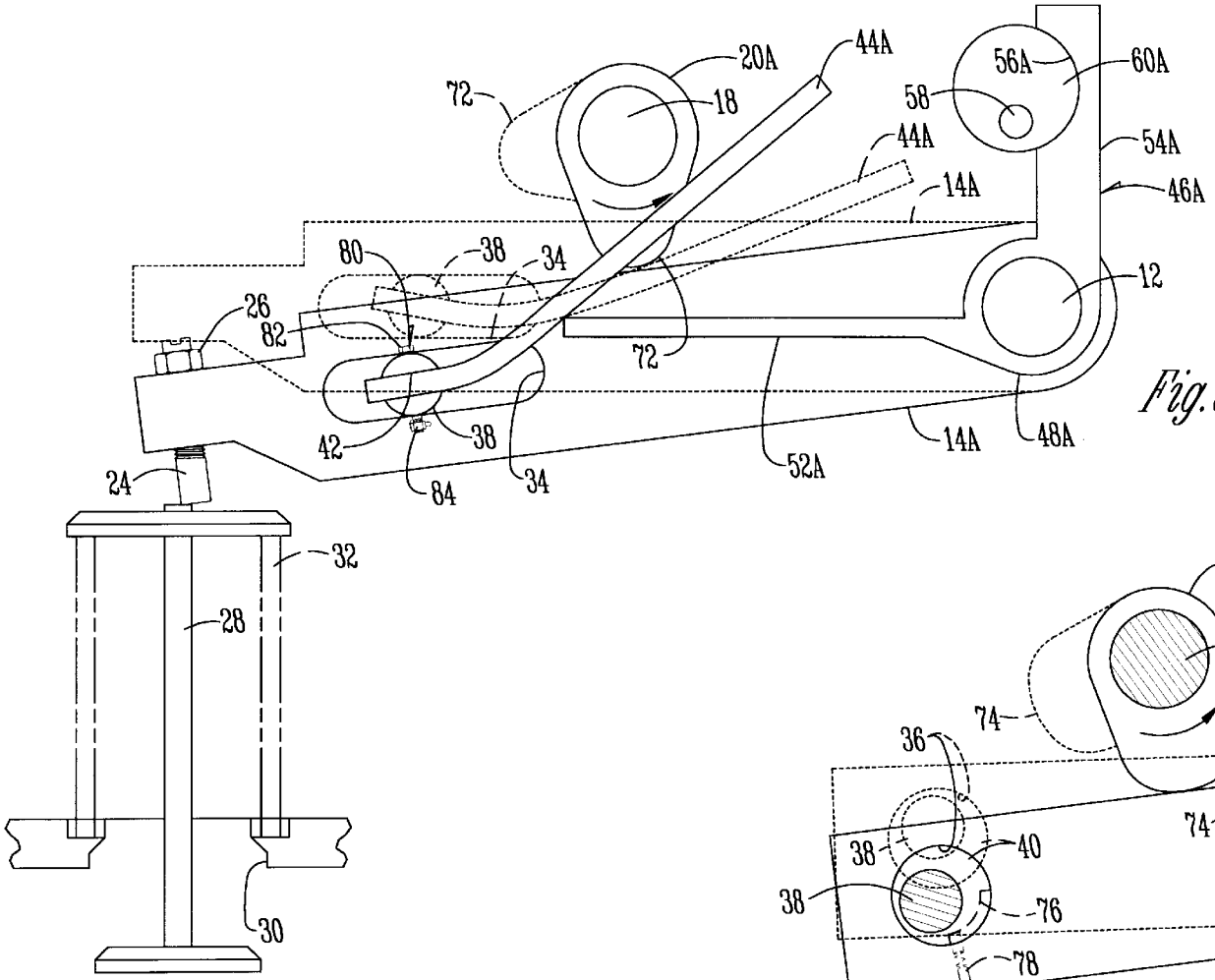
FIGS. 5 and 5A are similar to FIGS. 4 and 4A, but show the cam shaft rotated farther so that the cams open the valve to its maximum position.
Figure 5A:
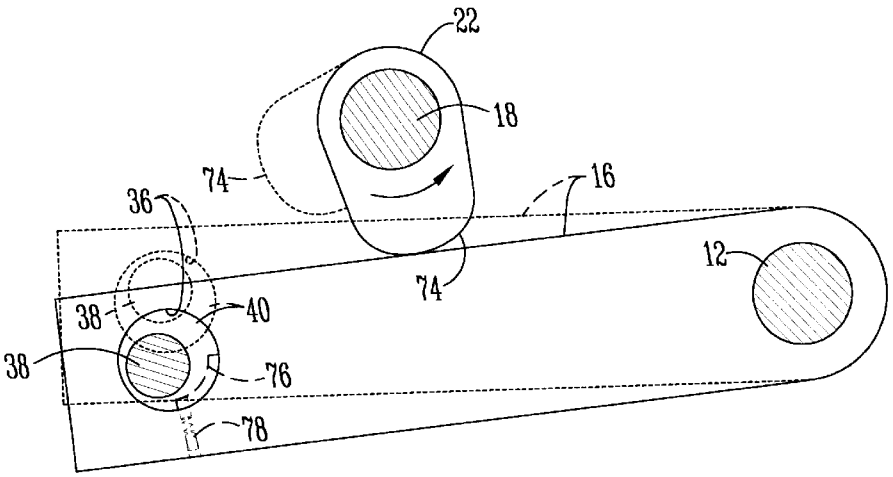

In FIG. 5A, the cam shaft 18 and thereby the high-speed cam 22 have been rotated counterclockwise so as to push the high-speed rocker arm 16 downward even farther than in FIG. 4A. In response, the eccentric wheel 40 and shaft 38 oscillate from approximately a 12 o'clock position, as indicated by the dashed lines, to approximately a 9 o'clock position, as shown by the solid lines. The oscillation moves the eccentric wheel 40 until the spring-loaded set screw 78 abuts an end of the slot. Since the shaft 38 can pivot no further because of the set screw 78, the oscillation and pressure from one or more of the cams 20A, 20B, 22 also cause the shaft 38 to move downward. The shaft 38 then abuts the slot 34 and, together with the low-speed cam 20A, pushes the low-speed rocker arm 14A to its lowest position, which forces the valve adjustment screw 24 downward and thereby moves the valve 28 to its maximum open position. See FIG. 5. The low-speed cam 20A pushes the low-speed rocker arm 14A away from the cam shaft 18 with the outermost point on its low-speed cam profile or lobe 72. The spring member 44A is rotated, as shown by the solid lines in FIG. 5. Preferably the cam profiles 72 and 74 are configured and phased such that the high-speed cam 22 controls the valves 28 by virtue of the timing and/or initial engagement and disengagement with the rocker arm 16. The rocker arms 14A, 14B follow because they are interconnected with rocker arm 16 by the shaft 38. However, eventually the cams 20A, 20B advance to the position shown in FIG. 5 and take over or at least share control of the valves 28 by driving them to their maximum open position. Then the high speed cam 22 resumes control during the closing of the valves 28.

This concludes the description of the regular, low-speed operation with the variable cam mechanism of this invention.

Figure 6:
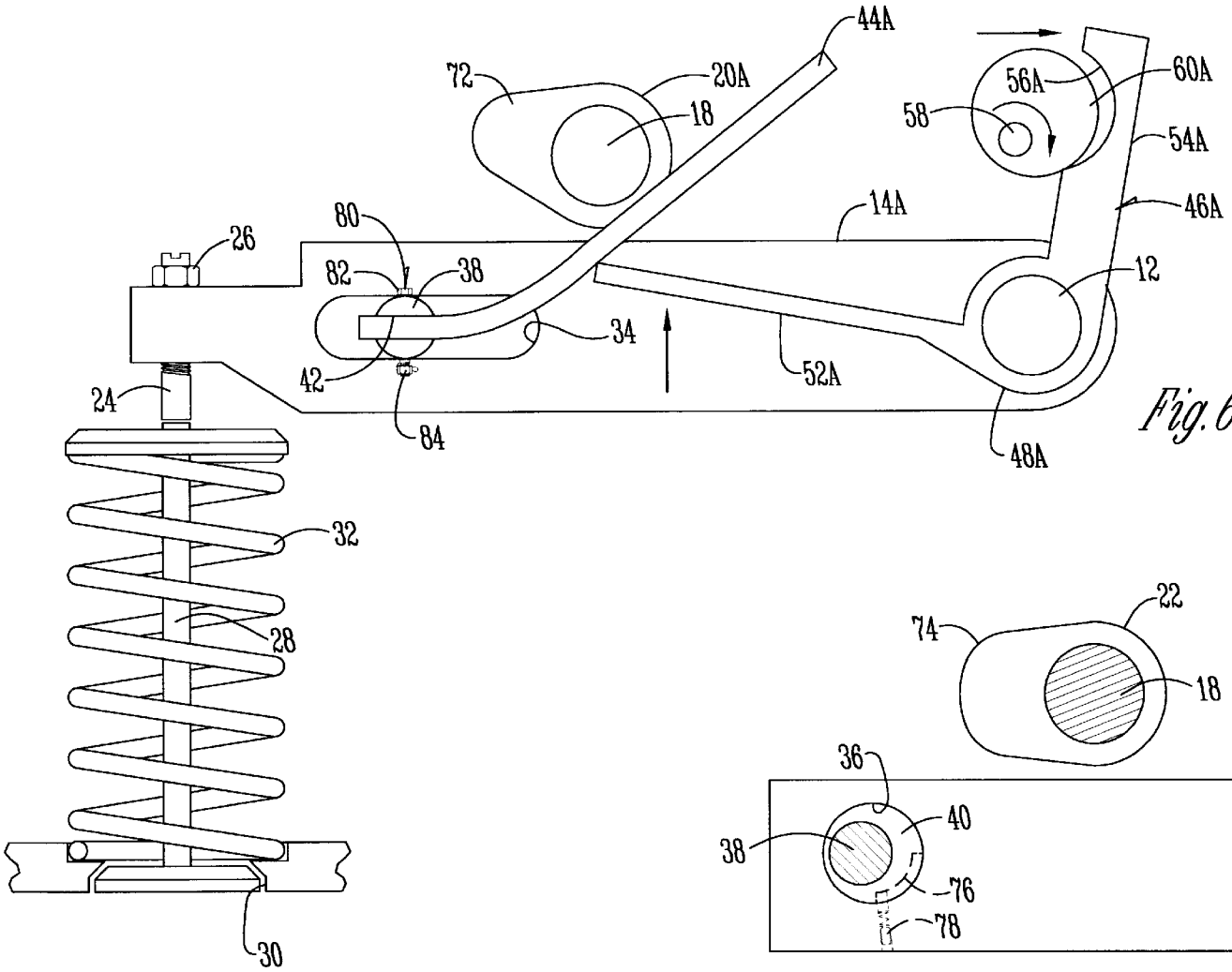
FIGS. 6 and 6A are similar to FIGS. 3 and 3A, but show the actuator being moved to put torsional tension on the spring and boost the performance of the engine.
Figure 6A:
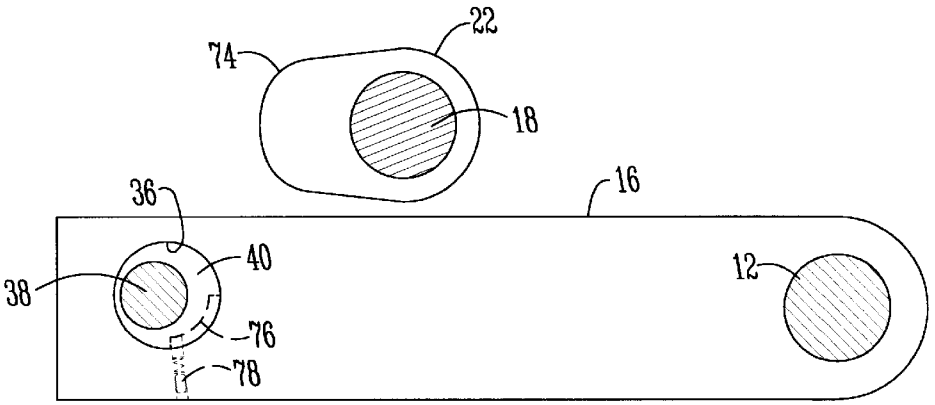

In the boosted, high-speed operation shown in FIGS. 6 and 6A, the actuating shaft 58 has been rotated clockwise by the shifter mechanism so that the eccentrically mounted cam 60A pivots the lever mechanism 46A in a clockwise direction as well, sending the spring-engaging arm 52A higher and thereby applying torsional force to the shaft 38. However, as best seen in FIG. 6A, the engagement of the springloaded set screw 78 with the end of the slot 42 prevents the shaft 38 and the eccentric wheel 40 attached thereto from oscillating. The cams 20A, 22, 20B do not engage the high-speed rocker arm 16 or the low-speed rocker arms 14A, 14B. Thus, the valve 28 remains tightly closed against the seat 30. With the exceptions of the positions of the actuator cam 60A, lever mechanism 46A, and spring members 44A, this orientation is similar to FIGS. 3 and 3A.

Figure 7:
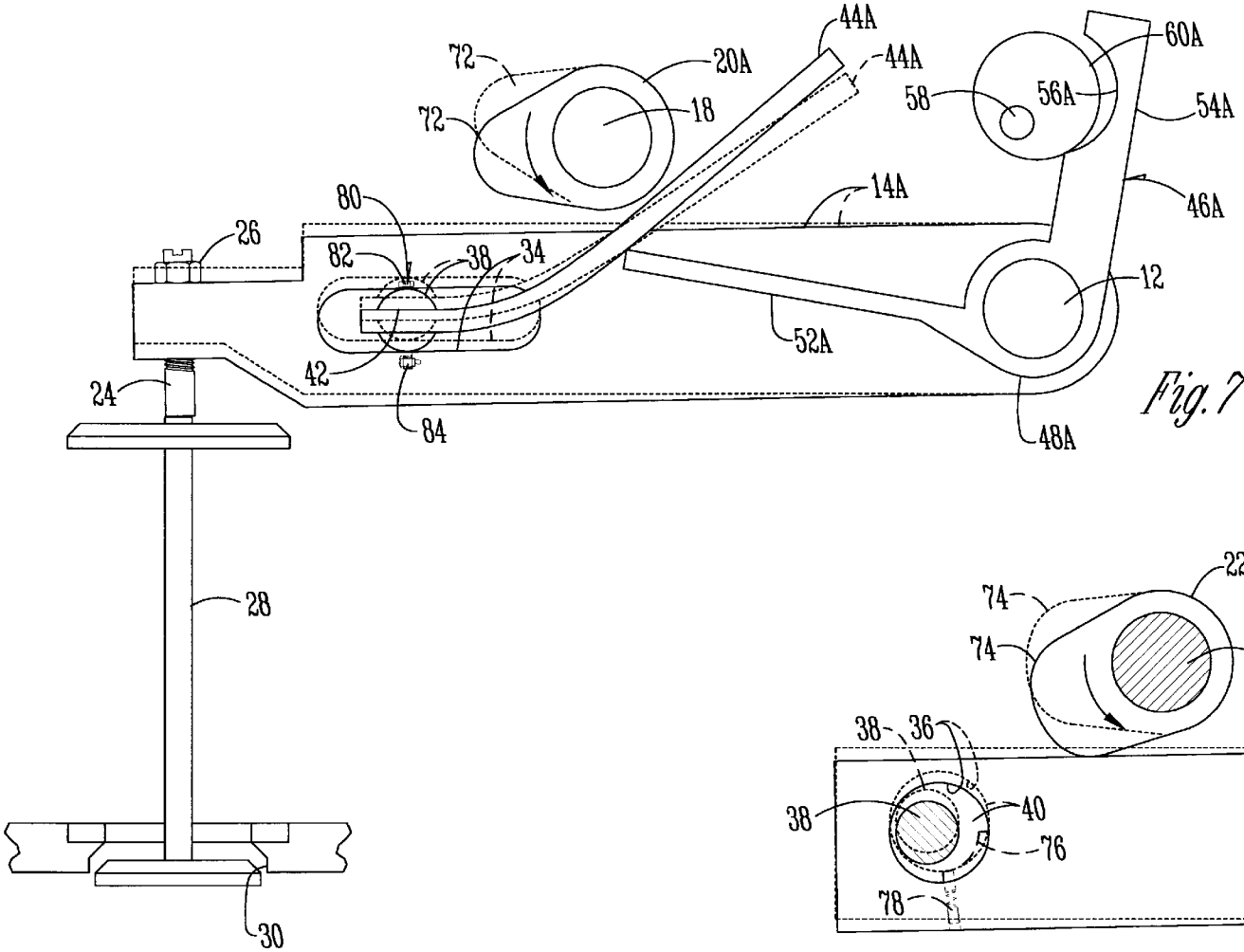
FIGS. 7 and 7A are similar to FIGS. 4 and 4A, but show the high-speed cam beginning to engage the high-speed rocker arm so as to oscillate the cam wheel and shaft to put tension on the spring. The valve is just beginning to open (i.e., the valve opens earlier than in the regular mode which is shown in FIGS. 4 and 4A).
Figure 7A:
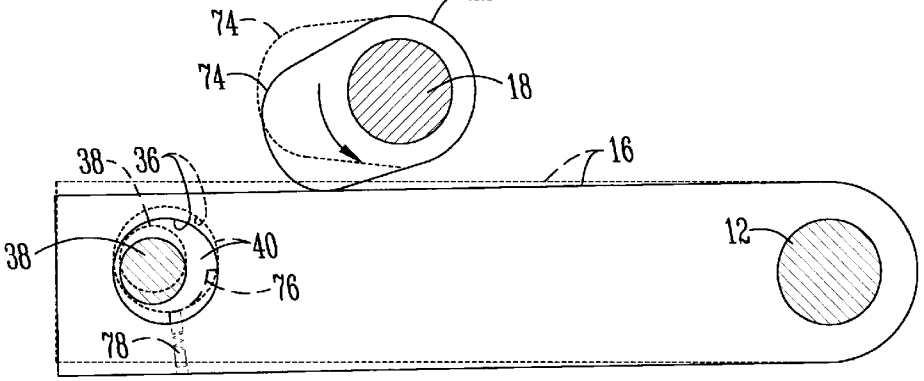

In FIGS. 7 and 7A, the cam shaft 18 has been rotated counterclockwise so that the high-speed cam 22 starts to engage the high-speed rocker arm 16 with the profile 74. This causes the eccentric wheel 40 and shaft 38 to oscillate to the position shown by the solid lines. In reality, the movement of the eccentric wheel 40 and shaft 38 may be substantially linear in this case because the set screw mechanism 78 is already in engagement with the end of the slot 42. When the shaft 38 oscillates, it puts additional tension on the spring 44A attached thereto. The rocker arms 16 and 14A move in unison by exactly the same amount because they are both controlled by the high-speed cam 22. The low-speed rocker arm 14A moves the valve 28 off its seat 30.

By comparing FIGS. 3–5A with FIGS. 6–8A, one will notice that the rotation of the actuator cam 60A has resulted in a "boost" (earlier and larger opening) of the valve 28. The boost can enhance performance at higher engine RPMs. Higher horsepower or performance is typically desired at higher engine RPMs, whereas fuel economy is typically desired at lower RPMs. Thus, the variable cam mechanism 10 of this invention provides the operator with the ability to shift into a particular mode to best meet the performance requirements desired at a given engine speed.

Figure 8:
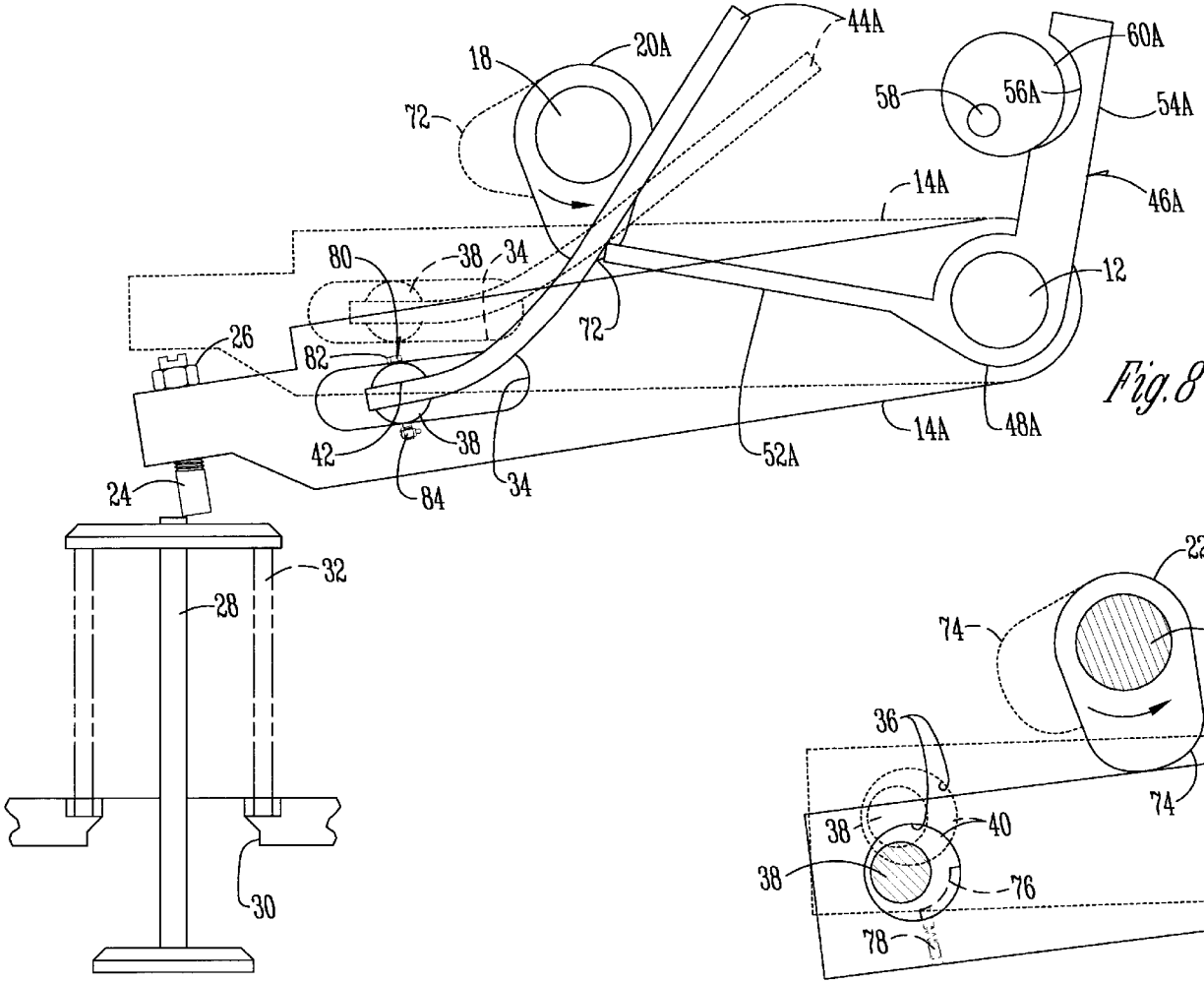
FIGS. 8 and 8A are similar to FIGS. 7 and 7A, but show the high-speed cam operating to depress the low-speed rocker arm and open the valve to its maximum open position, which results in a larger opening than that of the regular model shown in FIGS. 5 and 5A.
Figure 8A:
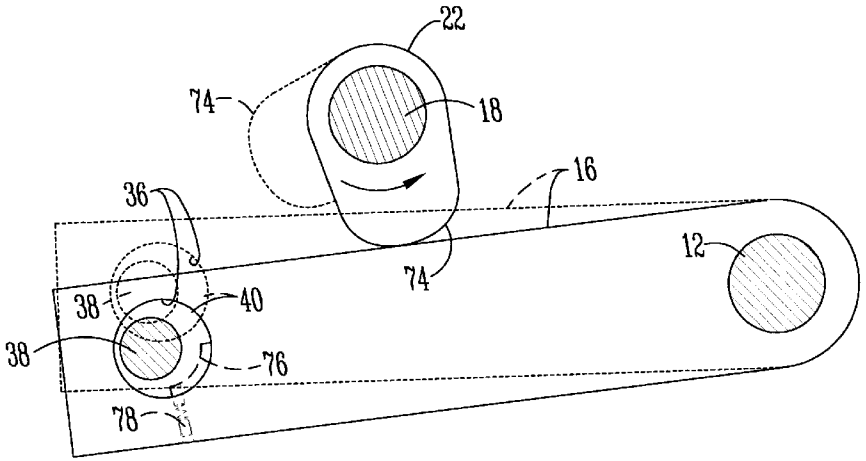

FIGS. 8 and 8A show the variable cam mechanism 10 in a boosted, high-speed mode with the valve 28 opened to its maximum position. The high-speed cam 22 is near the end of its duration or dwell on the high-speed rocker arm 16, but still controls the opening of the valves 28. The eccentric wheel 40 and shaft 38 move downwardly as far as they will go, taking the rocker arms 14A and 14B and the corresponding valves 28 with them. The resulting movement of the shaft 38 and spring-engaging lever 52A cause the spring 44A to deflect upwardly to its maximum position, as shown by the solid lines in FIG. 8. The low-speed cam 20A is rotated counterclockwise but does not contact the low-speed rocker arm 14A.

Essentially the present invention provides a spring biased boost cam which interconnects the rocker arms 14A, 14B, 16 so as to selectively move rocker arm 16 relative to the associated cam 22 to alter the predetermined angular position of contact, thereby affecting the extent, timing and duration of the movement of the valve 28. The spring biased boost cam includes shaft 38, eccentric wheel 40, slots 42, spring member(s) 44A, 44B, the aperture 36 in rocker arm 16. The spring biased boost cam is operated by an actuator which operatively includes lever mechanisms 46A, 46B, an actuating shaft 58, cams 60A, 60B and connecting means 62.

Figure 11:
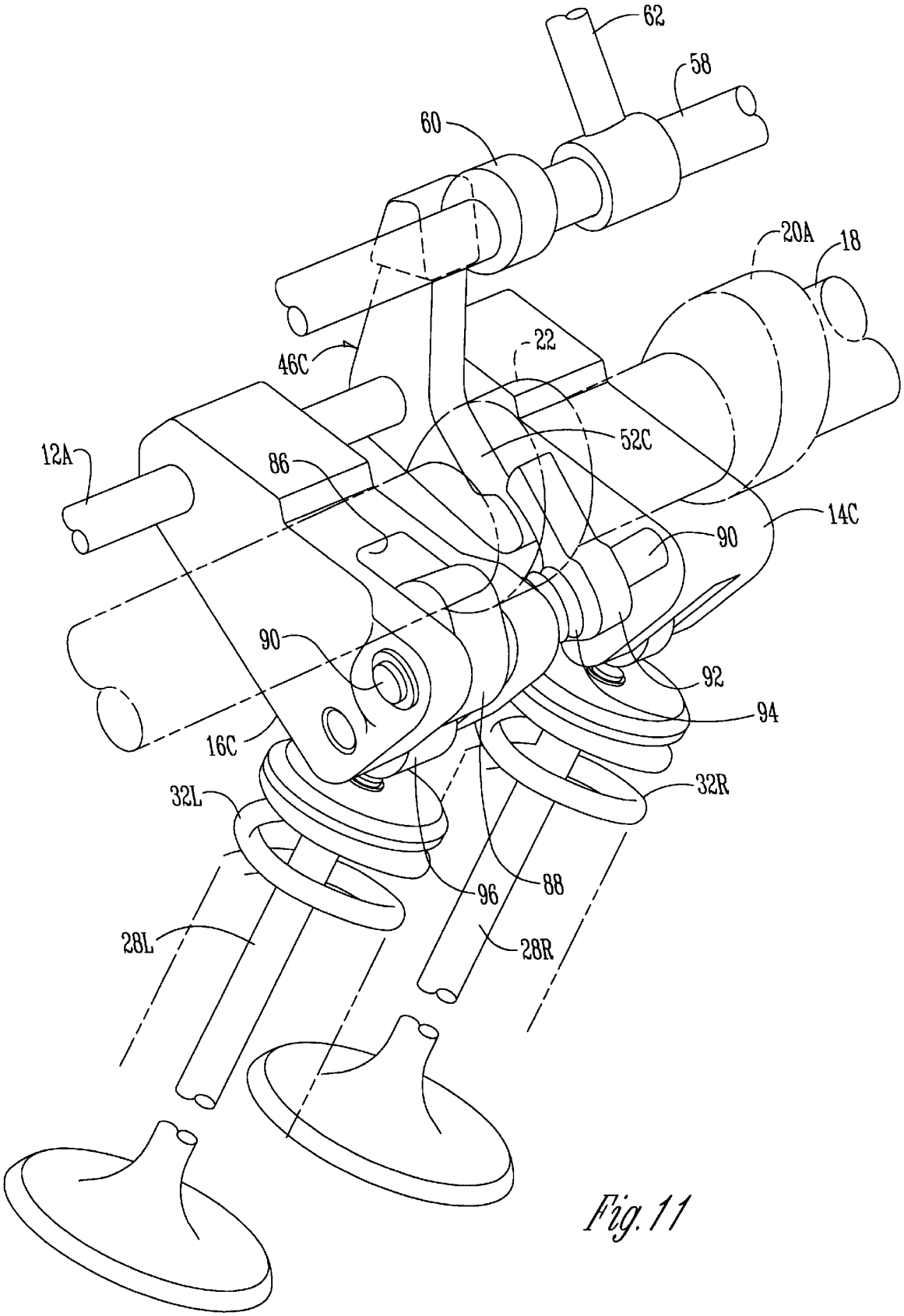
FIG. 11 is a perspective view of another embodiment of this invention in which there is only one low-speed rocker arm and the cam wheel is operatively connected to a torsional spring and can be rotated by the actuator to extend above the high-speed rocker arm and achieve a boosted mode by increasing the amount and duration of contact with the high-speed cam.

Another embodiment of the invention is shown in FIG. 11 wherein the high-speed rocker arm 16C has a slot 86 therein, and an eccentric cam wheel 88 is pivotally mounted therein on a pivot shaft 90. The pivot shaft 90 has a lever arm 92 secured for rotation therewith. Operatively mounted on the pivot shaft 90, between the lever arm 92 and the high-speed rocker arm 16C, is a coiled torsional spring.

A connecting means 62 connects an actuator shaft 58 and cam 60 rigidly mounted thereon to a suitable shifter lever or mechanism (not shown) in the operator's compartment. The cam 60 engages a lever mechanism 46C which is attached to the same pivot shaft 12A as the high-speed and low-speed rocker arms 16C, 14C. A forwardly extending arm 52C of the lever mechanism 46C extends in close proximity to the lever arm 92 between the rocker arms 14C, 16C.

When the actuator shaft 58 is rotated counterclockwise as viewed, the cam 60 pushes the lever mechanism 46C in a clockwise direction. The lever arm 52C then pushes the lever arm 92 between the rocker arms 14C, 16C in a counterclockwise direction as well. The resulting torsional force on the spring 94 turns and thereby raises the cam wheel 88 on the high-speed rocker arm 16C. Thus, the cam wheel 88 can be raised or lowered to vary the timing and duration of its contact with the high-speed cam 22.

Substantially cylindrical roller "lifters" 96 are operatively connected to the rocker arms 14C, 16C juxtapositioned above the valves 28R, 28L for selective engagement therewith.

Since the high-speed and low-speed rocker arms 16C and 14C are connected by the pivot shafts 12 and 90, the low-speed rocker arm 14C will move in conjunction with the high-speed rocker arm 16C and push the roller lifters 96 so as to open the valves 28L, 28R against the springs 32L, 32R. The rotation of the cam 60 boosts the opening size, timing and duration of the valves 28L, 28R. As in the previously described embodiment, the position of the actuator cam 60 and the cam 88 essentially define a boosted, high-speed mode and a regular, low-speed mode.

The torsional spring 94 yieldingly interconnects the cam wheel 88 and the lever arm 92, both of which are rigidly mounted on the rotatable pivot shaft 90, with the rocker arm 16C. One end of the spring 94 is attached to the lever arm 92 and the other end is attached to the rocker arm 16C so that the cam wheel 88 can be yieldingly urged to rotate and extend upward through the slot 86 to contact the cam 60.

In the embodiment of FIG. 11, the spring biased boost cam includes pivot shaft 90, cam 88, lever arm 92, torsional spring 94 and slot 86. The actuator includes a lever mechanism 46C, actuating shaft 58, cam 60 and connecting means 62.

The embodiments disclosed herein show the variable cam mechanism applied to intake valves, but the mechanism is also applicable to the exhaust valves of an engine. Additional valves can be controlled or coordinated by the mechanism of the present invention.

Therefore, the present invention at least achieves its stated objectives.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention.

What is claimed is:

1. A variable cam mechanism for controlling a valve in an engine, comprising:

a pivot shaft extending generally adjacent the valve;

first and second elongated rocker arms pivotally mounted on the pivot shaft and spaced apart from each other therealong, at least one of the first and second rocker arms being adapted to pivotally engage the valve so as to selectively open and close the valve;

a rotatable cam shaft extending generally parallel to the pivot shaft and generally transverse to the first and second rocker arms;

first and second eccentric cams being secured for rotation on the cam shaft and protruding outwardly therefrom toward the first and second rocker arms respectively so as to selectively contact and thereby pivot the respective first and second rocker arms with respect to the pivot shaft so that one of said arms moves the valve when the cam shaft is rotated to a predetermined angular position of contact;

a spring biased boost cam interconnecting the rocker arms and engaging the second rocker arm so as to selectively move the second rocker arm relative to the second eccentric cam to alter the predetermined angular position of contact and thereby duration of contact between the second eccentric cam and the second rocker arm and thereby the timing and duration of the movement of the valve; and an actuator pivotally mounted on the pivot shaft and connected with the spring biased boost cam for varying the spring bias applied to the boost cam so as to change the timing and duration of contact the boost cam makes with the second eccentric cam.

2. The variable cam mechanism of claim 1 wherein the spring biased boost cam includes an elongated cam rod having a boost cam wheel fixed eccentrically thereon, the cam wheel being mounted in the second rocker arm and generally registered with the second cam.

3. The variable cam mechanism of claim 2 wherein the spring biased boost cam includes a spring member operatively interconnecting the actuator and the cam rod for applying a torsional force to the cam rod.

4. The variable cam mechanism of claim 3 wherein the cam rod has opposite ends each having a centrally disposed slot therein and the spring member is an elongated bar member which has opposite ends, one end of the bar member being slidably inserted into one of the slots and secured for rotation with the cam rod.

5. The variable cam mechanism of claim 4 wherein the bar member is substantially straight in a free state.

6. The variable cam mechanism of claim 4 wherein the bar member has a rectangular cross-section.

7. The variable cam mechanism of claim 2 wherein the cam wheel is mounted in an aperture in the second rocker arm.

8. The variable cam mechanism of claim 1 wherein the boost cam includes a cam wheel having a peripheral surface with a circumferential slot extending at least partially around the peripheral surface having a pair of terminal ends between a spring-loaded set screw being mounted in the second rocker arm and extending into the slot to abut the terminal ends and thereby stop the cam wheel from rotating.

9. The variable cam mechanism of claim 8 wherein the spring-loaded set screw includes a detent portion adapted to be slidably received by the slot, a driver portion for threadably engaging the second rocker arm, and a coil compression spring operatively interposed between the detent portion and the driver portion for urging the detent portion into the slot.

10. The variable cam mechanism of claim 1 wherein the actuator comprises a pivotal actuator shaft offset and substantially parallel to the pivot shaft, the actuator shaft having an eccentric cam means rigidly mounted thereto and adapted to selectively engage and pivot the actuator to vary the bias on the biased cam boost.

11. The variable cam mechanism of claim 1 wherein one of the first and second eccentric cams has a profile comprising a substantially rectangular tongue portion protruding from the cam shaft and having rounded corners.

12. The variable cam mechanism of claim 1 wherein one of the first and second eccentric cams has a profile comprising opposite sides connected together at a blunted apex and forming an acute angle.

13. The variable cam mechanism of claim 3 wherein the spring member is a coiled torsional spring having generally opposite ends, one of the ends being operatively attached to the cam rod and the other end being operatively connected to the actuator.

14. The variable cam mechanism of claim 13 wherein the cam wheel is eccentrically and rotatably mounted in a vertical slot in the second rocker arm so as to extend above the second rocker arm at least some time during rotation.

15. The variable cam mechanism of claim 1 comprising a roller lifter operatively connected to the second rocker arm and juxtapositioned above the valve for selective engagement therewith.

16. The variable cam mechanism of claim 13 wherein the actuator comprises an L-shaped bracket having a pair of angularly spaced arms extending from a body member pivotally mounted on the pivot shaft.

17. The variable cam mechanism of claim 1 wherein the first and second eccentric cams each have an outer curved profile thereon directed radially outward from the cam shaft and toward the first and second rocker arms respectively so as to overlap each other at a given angle during rotation of the cam shaft.

18. The variable cam mechanism of claim 17 wherein one elongated side edge of the outer profile of the first eccentric cam is aligned with one elongated side edge of the outer profile of the second eccentric cam, said one elongated side edge of the second eccentric cam being adapted to contact the second rocker arm before other portions of the outer profile of the second eccentric cam when the cam shaft is rotated.

19. The variable cam mechanism of claim 2 wherein the boost cam wheel is integrally formed with the cam rod.

20. The variable cam mechanism of claim 2 wherein the first rocker arm includes an elongated slot therein for slidably receiving the cam rod.

21. A variable cam mechanism for controlling a pair of valves of an engine, comprising:

an elongated rocker arm support shaft;

an elongated first rocker arm pivotally mounted on the rocker arm support shaft and connected to a first valve of the pair of valves, the first rocker arm having an elongated slot therethrough extending generally longitudinally;

an elongated second rocker arm pivotally mounted on the rocker arm support shaft longitudinally spaced from the first rocker arm, the second rocker arm being connected to a second valve of the pair of valves, the second rocker arm having an elongated slot therethrough;

an elongated intermediate arm pivotally mounted on the rocker arm support shaft spaced between the first and second rocker arms; the intermediate arm having a hole therethrough radially offset from and parallel to the rocker arm support;

a rotatable cam shaft extending generally transversely across the first, second, and intermediate arms and having first, second, and intermediate longitudinally spaced cams thereon generally registered with the first, second, and intermediate arms respectively;

a boost shaft having opposite ends and an eccentric wheel portion rigidly mounted therebetween; the eccentric wheel portion being pivotally housed in the hole in the intermediate arm, the ends of the boost shaft extending pivotally and slidably through the elongated slots in the first and second rocker arms respectively;

first and second spring mechanisms operatively connected to the ends of the boost shaft respectively for yieldingly applying a torsional force thereto;

a stop means on the intermediate arm for operatively engaging the eccentric wheel portion and limiting the pivoting thereof; and an actuator operatively connected to the first and second spring mechanisms for varying the torsional force applied to the boost shaft by the spring mechanisms and stop means;

whereby when the actuator is moved to a first position the actuator urges the first and second spring mechanisms into a free state in which the first and second spring mechanisms engage the boost shaft without introducing a torsional force thereto;

whereby when the actuator is moved to a second position the actuator urges the first and second spring mechanisms into a tensioned state in which the first and second spring mechanisms engage the boost shaft and introduce a torsional force thereto thereby boosting the performance of the engine.

22. The variable cam mechanism of claim 21 wherein the profiles of the first and second cams are identical.

23. The variable cam mechanism of claim 21 wherein the profiles of the first and second cams have opposite sides connected together at a blunted apex and forming an acute angle.

24. The variable cam mechanism of claim 21 wherein the intermediate cam has a profile comprising a substantially rectangular tongue portion protruding from the cam shaft and having rounded corners.

25. The variable cam mechanism of claim 21 wherein the first and second rocker arms are low speed rocker arms and the intermediate arm is a high speed boost arm.

26. The variable cam mechanism of claim 21 wherein the first, second, and intermediate cams have respective profiles and the first and second cams taper inwardly more rapidly than the profile of the intermediate cam.

27. The variable cam mechanism of claim 21 wherein the first position of the actuator is adapted for low speed operation of the engine and the second position of the actuator is adapted for high speed operation of the engine.

28. The variable cam mechanism of claim 21 wherein the stop means engages the eccentric wheel portion to resist the torsional force applied to the boost shaft.

* * * * *